US006024269A

United States Patent [19]

Ho et al.

[11] Patent Number: 6,024,269

[45] Date of Patent: Feb. 15, 2000

[54] CYLINDER INLET VALVE FOR A POWER STAPLER

[75] Inventors: Roman Ho; Jack Chen; Sunking Hung, all of Taichung, Taiwan

[73] Assignee: Basso Industry Corp, Taichung, Taiwan

[21] Appl. No.: 09/263,578

[22] Filed: Mar. 8, 1999

[51] Int. Cl.[7] ..... B25C 1/04

[52] U.S. Cl. ..... 227/130

[58] Field of Search ..... 227/8, 10, 130; 91/307, 308, 317

[56] References Cited

U.S. PATENT DOCUMENTS

| | | | |
|---|---|---|---|
| 4,566,619 | 1/1986 | Kleinholz | 227/130 |
| 5,671,880 | 9/1997 | Ronconi | 227/8 |
| 5,676,300 | 10/1997 | Nakazato et al. | 227/130 |
| 5,782,395 | 7/1998 | Sauer | 227/130 |
| 5,829,660 | 11/1998 | White | 227/130 |

*Primary Examiner*—Scott A. Smith
*Attorney, Agent, or Firm*—Charles E. Baxley, Esquire

[57] ABSTRACT

A cylinder inlet valve for a power stapler includes a head member connected to the rear end of the barrel of the stapler and a cap movably connected between the head member and the cylinder between which a seal is connected which has a flexible portion so that when the cap is moved, the seal is removed from the cylinder and the flexible portion is extended and the sealed situation between the cap and the head member is maintained. Another seal is mounted to the neck portion of the cap with its tongue portion and connected between the neck portion and the short flange of the head member, so that the friction between the neck portion of the cap and the tongue portion is small when the cap is moved.

4 Claims, 4 Drawing Sheets

CYLINDER INLET VALVE FOR A POWER STAPLER

FIELD OF THE INVENTION

The present invention relates to an inlet valve structure for a cylinder in a power stapler and which has a sealing member securely connected to a movable cap and a head member in which the movable cap is received, the sealing member having a flexible portion so that when the cap is moved, the flexible portion still seals the space between the cap and the head member.

BACKGROUND OF THE INVENTION

A conventional power stapler is partially disclosed in FIG. 1 and comprises a barrel 15 with a handle connected thereto which has a trigger means 17 connected thereto. A cylinder 16 is fixedly received in the barrel 15 and has a piston 18 movably received therein so as to push an actuating plate 19 connected thereto when the high pressure is introduced into the cylinder 16 via the space defined between the cylinder 16 and the inlet valve. The inlet valve includes a movable cap 12 which is located between the cylinder 16 and the head member 11 which is fixedly attached to the inside of the barrel 15. The head member 11 has a central hole 111 defined in the center thereof so that the neck portion 121 of the cap 12 extends through the central hole 111 with a seal 112 received between the neck portion 121 and the head member 11. The cap 12 further has a flange 122 extending radially inward from the inside of the neck portion 121 so that a spring 13 is biased between the flange 122 and the rear end board 14 of the barrel 15. The cap 12 has two grooves defined in the outside thereof so as to receive a seal 125 therein which is to be moved along the inner surface of a flange 113 when the cap 12 is moved. Yet another seal 126 is mounted to the cap 12 so as to seal the space between the end of the cylinder 16 and the cap 12. When operating the trigger means 17, the high pressure in the space 120 to push the cap 12 toward the cylinder 16 is released via the pipe 170 which is controlled by the trigger means 17 so that the high pressure in the space 150 around the cylinder 16 pushes the cap 12 toward the rear end board 14 and enters into the cylinder 16 to push the piston 18 to send a staple (not shown) by the actuating plate 19. After the piston 18 is pushed, the spring 13 pushes the cap 12 back to its original position again. During the operation, the seal 112, 125 and 126 perform an import role to ensure there has no leak between the head member 11, the cap 12 and the cylinder 16 so as to precisely push the piston 18. However, the seals 112, 125 and 126 then to be worn out because they are moved during each movement of the cap 12. Accordingly, the seals 112, 125 and 126 have to be replaced frequently and this is disadvantageous for the users.

The present invention intends to provide an improved inlet valve which employs a sealing member connected between the movable cap and the fixed head member. The sealing member has a flexible portion which can be extended when the cap is moved so as to seal the space between the head member and the cap without moving. By this structure, the shortcomings of the conventional power stapler can be mitigated.

SUMMARY OF THE INVENTION

In accordance with one aspect of the present invention, there is provided an inlet valve for a cylinder in a power stapler, and comprising a head member connected to rear end of the barrel and located between the rear end board and the cylinder. The head member has an inner tube and a transverse flange extending radially inward from the inner tube so that a central hole is defined through the center of the head member. A branch flange extends laterally from the transverse flange. A cap has a neck portion extending through the central hole and having a short flange for a spring being biased between the rear end board and the short flange. A first seal is mounted to the neck portion and received between the branch flange of the head member and the neck portion of the cap. An annular space is defined between the cap and the first seal. A second seal is fixedly connected between the inner tube and the cap. The second seal has a flexible portion and contacts against the cylinder.

It is an object of the present invention to provide a cylinder inlet valve which employs only two seals.

Another object of the present invention is to provide a cylinder inlet valve wherein the friction between the seals and the movable cap is small.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 2:
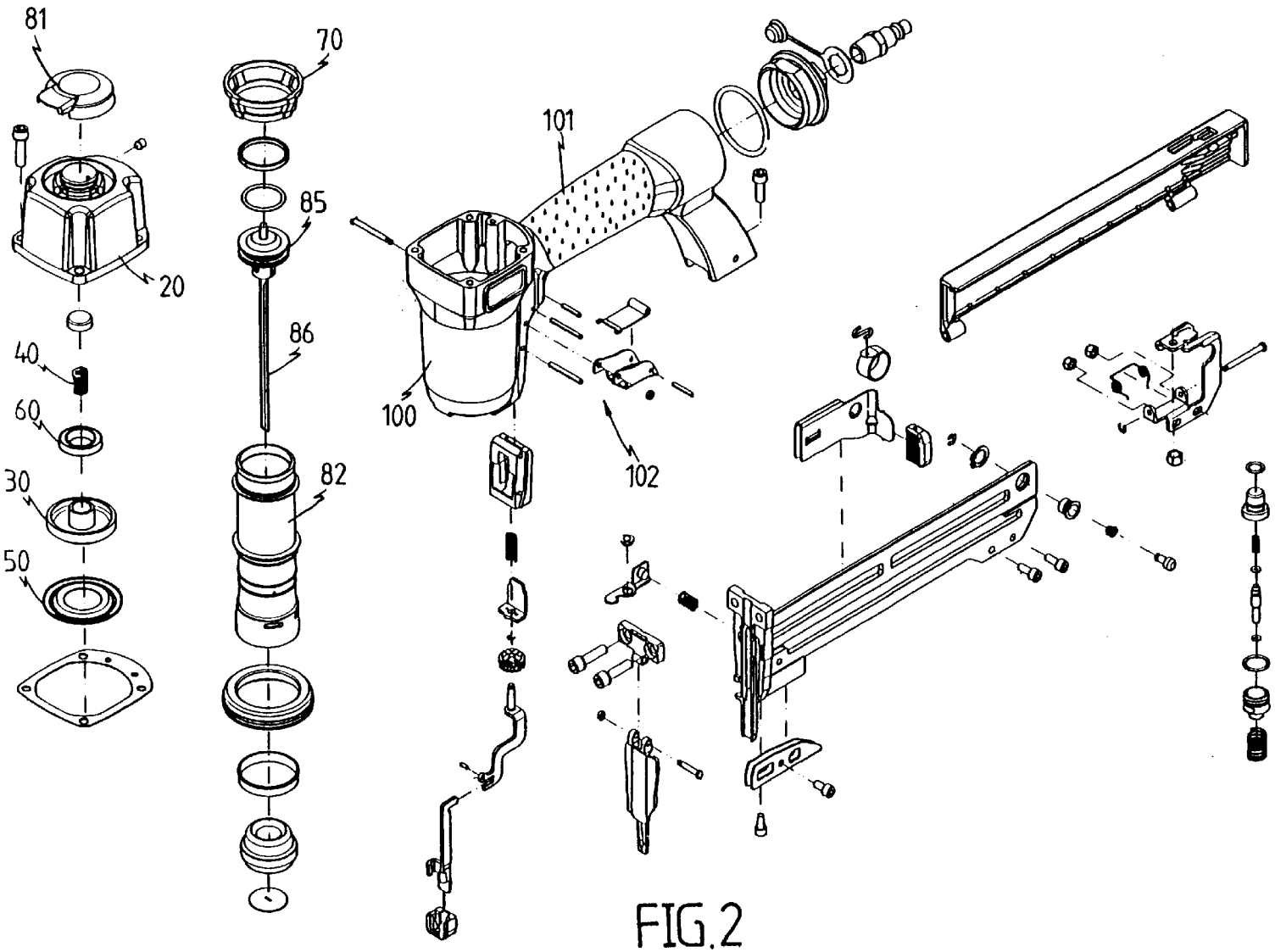
FIG. 2 is an exploded view of the cylinder valve in the power stapler in accordance with the present invention.
Figure 3:
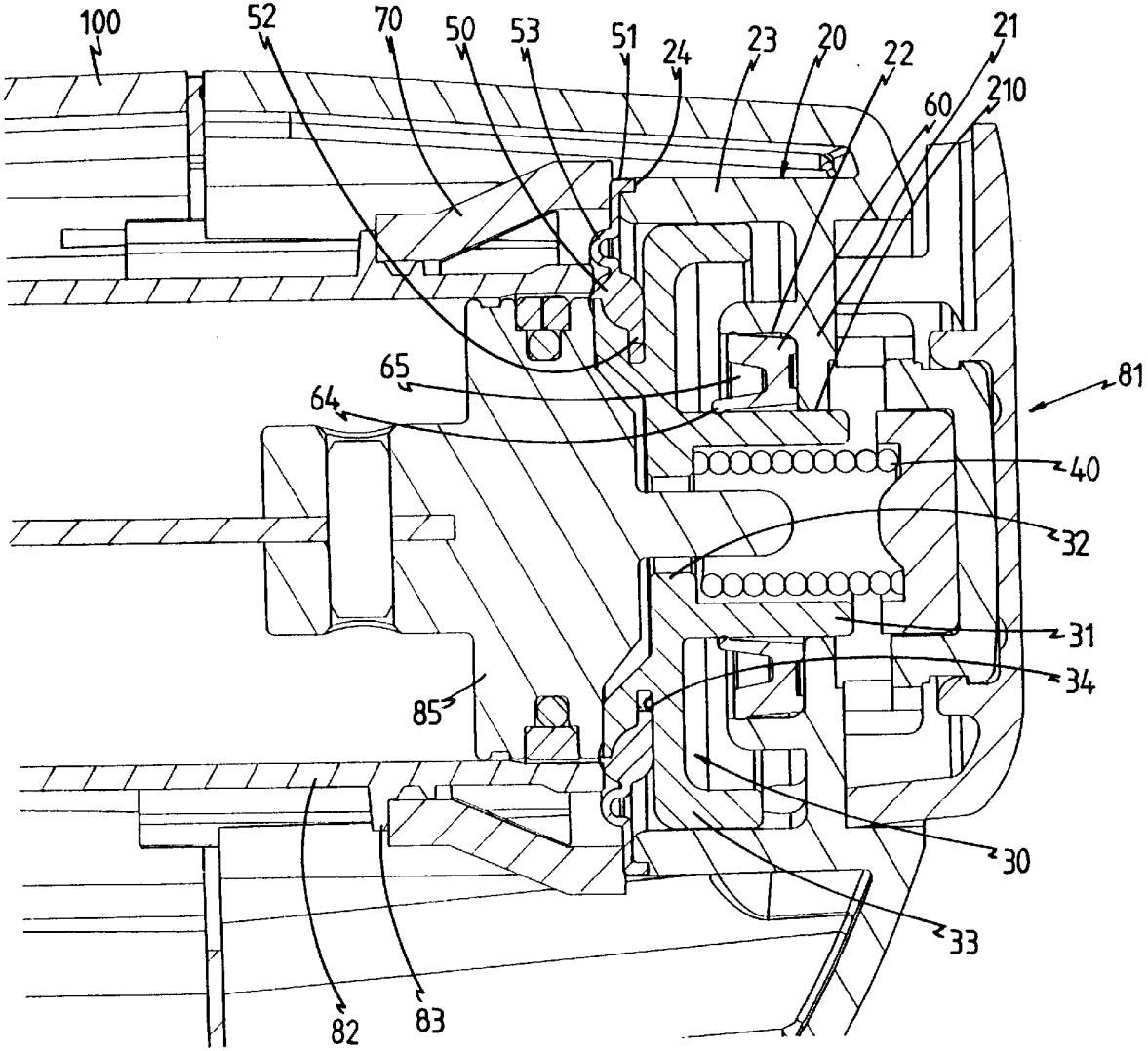
FIG. 3 is a side elevational view, partly in section, of the cylinder valve in accordance with the present invention when the cap is not moved away from the cylinder.

Referring to FIGS. 2 and 3, a power stapler has a cylinder 82 received in the barrel 100 thereof which has a handle 101 connected thereto which has a trigger means 102 connected thereto. An rear end board 81 is attached to the rear end of the barrel 100. The cylinder inlet valve for the power stapler in accordance with the present invention comprises a head member 20 which is connected to rear end of the barrel 100 and located between the rear end board 81 and the cylinder 82. The head member 20 has an inner tube 23 from which a transverse flange 21 extends radially inward so as to define a central hole 210 through the center of the head member 20. A branch flange 22 extends laterally from the transverse flange 21 and toward the cylinder 82 and the inner tube 23 has an annular notch 24 defined in the distal edge thereof.

A cap 30 has a skirt portion 33 which is movably received in the inside of the inner tube 23 of the head member 20. The cap 30 further has a neck portion 31 which extends through the central hole 210 and has a short flange 32 extending radially inward therefrom. A spring 40 is biased between the rear end board 81 and the short flange 32. The cap 30 has an annular groove 34 defined in the end opposite to the neck potion 31 and the piston 85 contacts the outside of the end opposite to the neck portion 31.

A first seal 60 shaped substantially as a letter of "H" is mounted to the neck portion 31 and received between the branch flange 22 of the head member 20 and the neck portion 31 of the cap 30. The first seal 60 has a tongue portion 64 extending therefrom so as to securely mount to the neck portion 31 of the cap 30 so that the friction between the first seal 60 and the neck portion 31 of the cap 30 is small when the cap 30 is moving. An annular space 65 is defined between the cap 30 and the first seal 60, the annular space 65 communicating with the space between the skirt portion 33 of the cap 30 and the transverse flange 21, and the trigger means 102.

A second seal 50 has the inner edge 52 thereof fixedly received in the annular groove 34 in the cap and the outer edge 51 thereof fixedly engaged with the annular notch 24 of the inner tube 23. A flexible portion 53 is connected between inner edge 52 and the outer edge 51 of the second seal 50. The second seal 50 contact against the end of the cylinder 82 so as to prevent pressurized air in the space 65 entering into the cylinder 82.

A sleeve 70 has one end thereof fixedly engaged with a base 83 extending radially outward from the cylinder 82 and the other end of the sleeve 70 contacts against the outer edge 51 of the second seal 50 so that the outer edge 51 will not removed from the notch 24.

Figure 1:
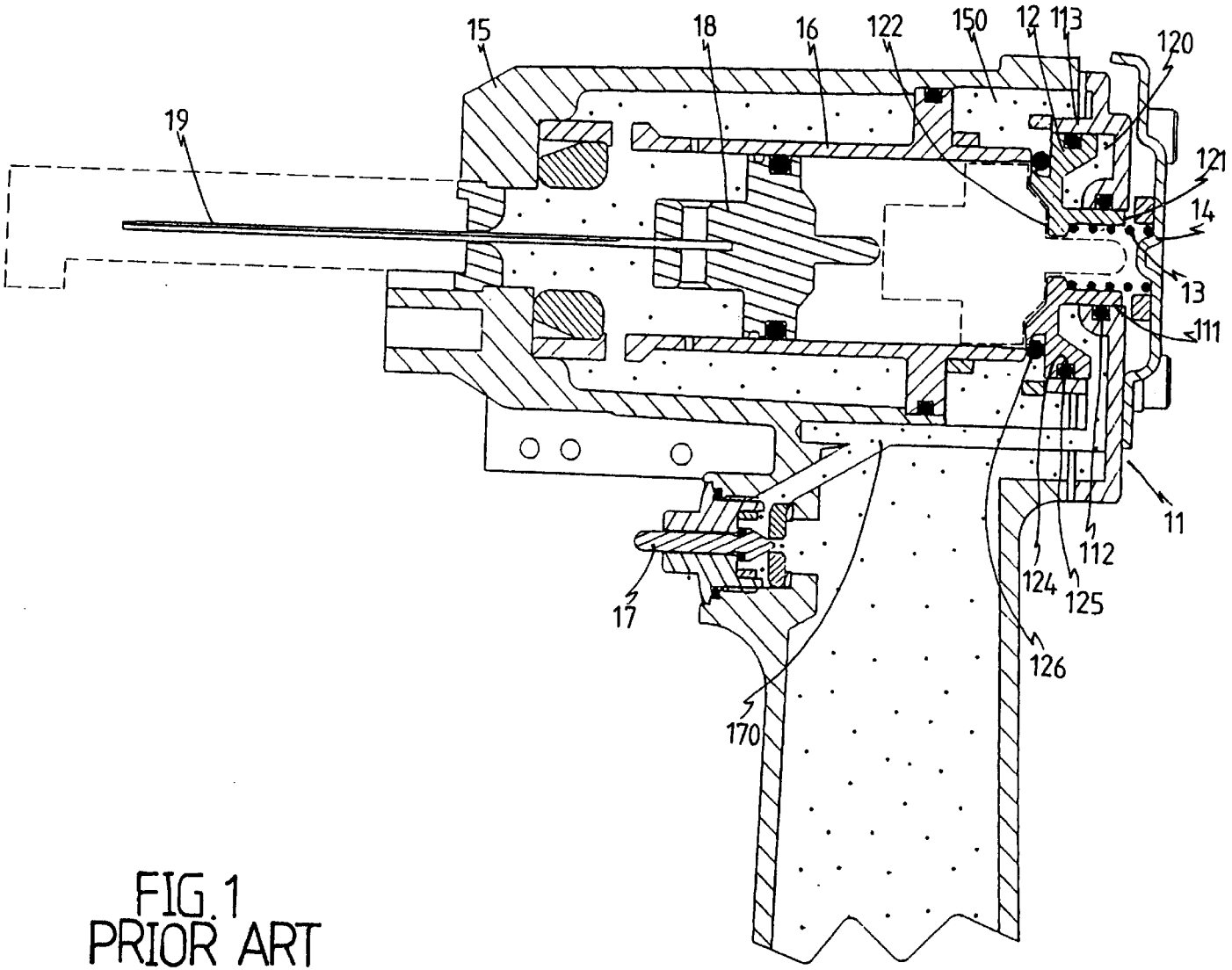
FIG. 1 PRIOR ART
FIG. 1 is a side elevational view, partly in section, of the conventional power stapler.
Figure 4:
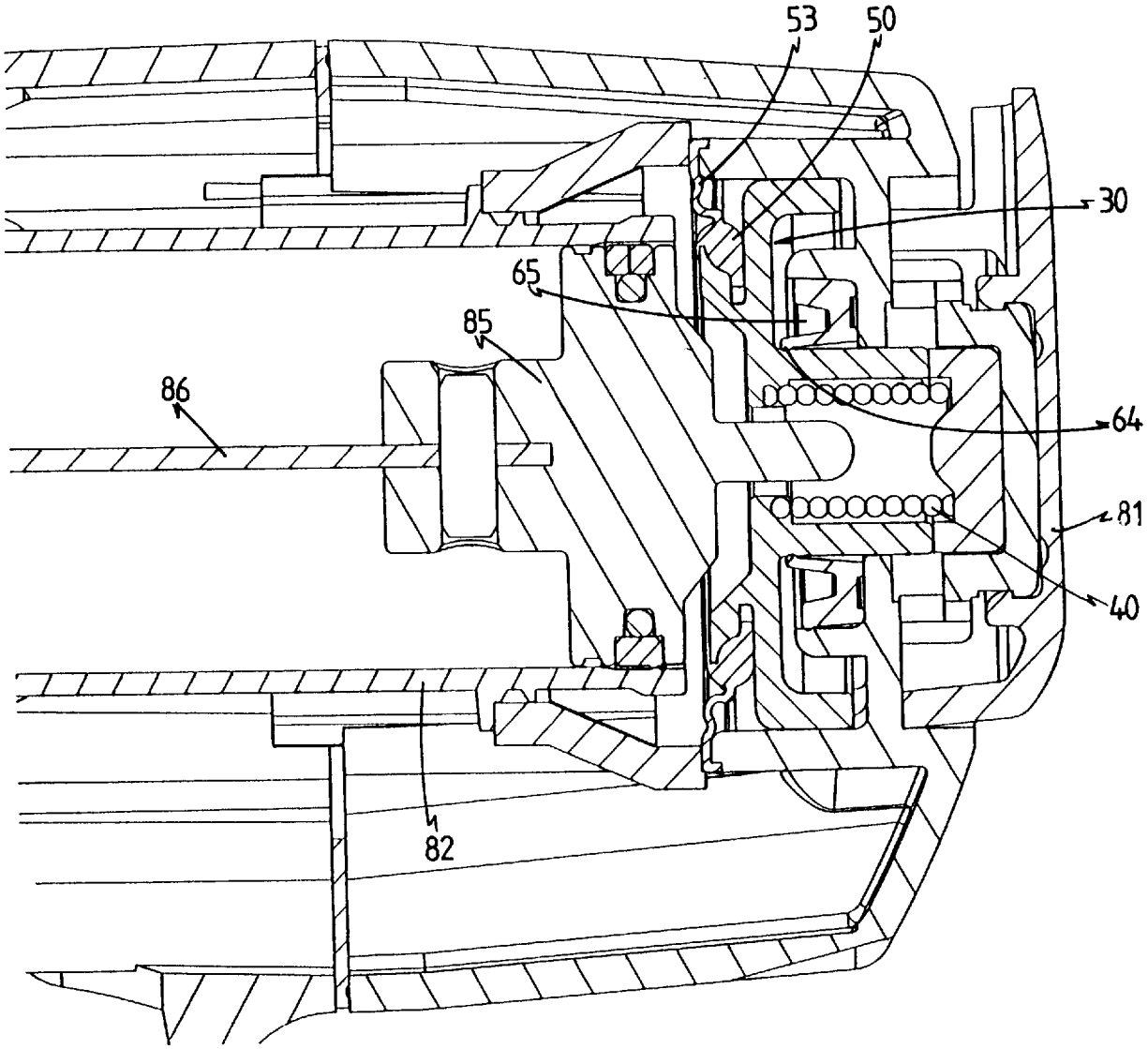
FIG. 4 is a side elevational view, partly in section, of the cylinder valve in accordance with the present invention when the cap is moved away from the cylinder.

Referring to FIG. 4, when the trigger means 102 is operated, the pressure in the space 65 and the space between the skirt portion 33 and the transverse flange 21 is released via a pipe (not shown and similar to that disclosed in FIG. 1) so that the cap 30 is therefore moved toward the rear end board 81 to let high pressurized air around the cylinder 82 enter into the cylinder 82 to push the piston 85 via the gap defined between the cylinder 82 and the second seal 50 which is moved with the cap 30. A staple (not shown) will be ejected by the actuating plate 86 connected to the piston 85. After the piston 85 is pushed, the pressure around the cylinder 82 is reduced and the cap 30 is moved toward the cylinder 82 to its original position by the spring 40.

By this structure, when the cap 30 is moved, a very limited friction is required to the tongue portion 64 of the first seal 60 so that the term of use of the first seal 60 is prolonged. There is few friction for the second seal 50 because only the flexible portion 53 is deformed when the cap 30 is moved.

While we have shown and described various embodiments in accordance with the present invention, it should be clear to those skilled in the art that further embodiments may be made without departing from the scope and spirit of the present invention.

What is claimed is:

1. A cylinder inlet valve for a power stapler which has a cylinder (82) received in the barrel (100) thereof and a handle (101) is connected to the barrel (100), a trigger means (102) connected to the handle (101) and an rear end board (81) attached to the rear end of the barrel (100), the cylinder inlet valve comprising:

a head member (20) adapted to be connected to the rear end of the barrel (100) and located between the rear end board (81) and the cylinder (82), said head member (20) having an inner tube (23) and a transverse flange (21) extending radially inward from said inner tube (23), a central hole (210) defined through the center of said head member (20), a branch flange (22) extending laterally from said transverse flange (21);

a cap (30) having a neck portion (31) extending through said central hole (210) and said neck portion (31) having a short flange (32) extending radially inward therefrom, a spring (40) biased between said rear end board (81) and said short flange (32);

a first seal (60) mounted to said neck portion (31) and received between said branch flange (22) of said head member (20) and said neck portion (31) of said cap (30), an annular space (65) defined between said cap (30) and said first seal (60), said annular space (65) adapted to communicate with the trigger means (102), and a second seal (50) fixedly connected between said inner tube (23) and said cap (30), said second seal (50) having a flexible portion (53) and adapted to contact against the cylinder (82).

2. The cylinder inlet valve as claimed in claim 1, wherein said cap (30) has an annular groove (34) defined in the end opposite to said neck potion (31) and said inner tube (23) has an annular notch (24) defined in the distal edge thereof, said second seal (50) having the inner edge (52) thereof fixedly received in said annular groove (34) in said cap and the outer edge (51) thereof fixedly engaged with said annular notch (24) of said inner tube (23).

3. The cylinder inlet valve as claimed in claim 1 further comprising a sleeve (70) which is adapted to be fixedly mounted to said cylinder (82) and contacts against said outer edge (51) of said second seal (50).

4. The cylinder inlet valve as claimed in claim 1, wherein said first seal (60) has a tongue portion (64) extending therefrom so as to securely mount to said neck portion (31) of said cap (30).

* * * * *